US007288350B2

(12) United States Patent
Erk et al.

(10) Patent No.: US 7,288,350 B2
(45) Date of Patent: Oct. 30, 2007

(54) PHOTOCONDUCTOR MEMBER WITH BOUND SILICONE OIL

(75) Inventors: Donna Marie Erk, Louisville, CO (US); Kasturi Rangan Srinivasan, Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 397 days.

(21) Appl. No.: 11/058,642

(22) Filed: Feb. 15, 2005

(65) Prior Publication Data

US 2006/0183041 A1 Aug. 17, 2006

(51) Int. Cl.
*G03G 5/047* (2006.01)

(52) U.S. Cl. ..... 430/58.2; 430/56; 430/66

(58) Field of Classification Search ..... 430/58.2, 430/66, 56

See application file for complete search history.

(56) References Cited

U.S. PATENT DOCUMENTS

| | | | | |
|---|---|---|---|---|
| 4,119,461 | A * | 10/1978 | Yamada et al. | 430/88 |
| 5,994,014 | A | 11/1999 | Hinch et al. | |
| 6,001,523 | A | 12/1999 | Kemmesat et al. | |
| 2002/0039698 | A1 * | 4/2002 | Sasaki et al. | 430/58.2 |
| 2003/0059695 | A1 | 3/2003 | Li et al. | |

* cited by examiner

*Primary Examiner*—Christopher RoDee
(74) *Attorney, Agent, or Firm*—John A. Brady

(57) ABSTRACT

A charge transfer layer system that encapsulates or surrounds high viscosity silicone oils (polysiloxanes) using silicone microspheres, fluoropolymers such as polytetrafluoroethylene or inorganic particles such as silica, or metal soaps (zinc stearate). The encapsulation of the silicone oil results in aggregation or agglomeration of the silicone microspheres, fluoropolymers, or inorganic particles. The silicone oils have viscosity greater than 10,000 centistokes (cs) and the particles are about 6 μm or less.

30 Claims, No Drawings

PHOTOCONDUCTOR MEMBER WITH BOUND SILICONE OIL

TECHNICAL FIELD

This invention relates to photoconductors for electrophotographic imaging and more particularly to novel charge transport blends for improving lubricity and wear properties of the charge transport layer.

BACKGROUND OF THE INVENTION

An electrophotographic photoreceptor essentially comprises a charge generation layer (CGL) and charge transport layer (CTL) coated on a suitable substrate. The substrate may be an aluminized MYLAR polyester or an anodized aluminum drum. An aluminum drum can be coated with a suitable sub-layer and/or a barrier layer, derived by dispersing metal oxides in a polymer binder.

The charge generation layer comprises pigments or dyes selected from phthalocyanines, squaraines, azo compounds, perylenes, etc. The pigment or dye may be dispersed or dissolved in a suitable solvent, with or without a polymer binder.

The charge transport layer comprises a charge transport material or multiple charge transport materials in a polymer binder matrix. Additives such as fluoropolymers or inorganic oxides may also be used. An overcoat layer comprising only a polymer layer or a charge transport material-polymer composite may also be used. Typically, the charge transport layer is the outer layer and is subject to wear from movement in contact with other items such as rollers, doctor blades and the toner. An area of active interest is to increase the life of the photoconductor drum or member.

There are several approaches that have been used to achieve increased life. Incorporation of lubricants or inorganic oxides is known to help lower wear or abrasion. These lubricants can be polysiloxanes or silicone oils, or fluoropolymers, and the inorganic materials may be silica, titania, etc. The use of lubricants such as silicone oils is easy to implement. However, it is difficult to constantly lubricate the surface, as the silicone oil may be removed on contact with paper or toner. High concentrations of silicone oil can result in poor coating quality and result in coating defects that eventually translate to print defects. Excess silicone oil can also be detrimental to print performance.

Other methods involve the use of materials that are capable of undergoing cross-linking reactions in the outer layer of the photoconductor member. Cross-linking reactions may be brought about by either chemical reactions or subjecting the cross-linkable materials to photoradiation. The use of catalysts to promote the chemical reaction leading to cross-linking will require the material to be inert to the electrophotographic process. Most catalysts are ionic, acidic or alkaline. Non-inert catalysts, although used in small amounts, can have a significant impact on the electrostatics of the photoconductor member. Use of photoradiation may result in cross-linking reactions only at the surface layers, possibly a few microns in thickness and not in the bulk.

Hence, there is a need to experiment and formulate systems that impart good wear characteristics.

DISCLOSURE OF THE INVENTION

This invention describes the system that encapsulates or surrounds high viscosity silicone oils (polysiloxanes) using silicone microspheres, fluoropolymers such as polytetrafluoroethylene or inorganic particles such as silica, or metal soaps (zinc stearate). The encapsulation of the silicone oil results in the silicone oil being bound in an aggregation or agglomeration of the silicone microspheres, fluoropolymers, or inorganic particles. The silicone oils have viscosity greater than 10000 centistokes (cs).

The aggregation of the particles around the silicone oil may be suitably adjusted to derive aggregate sizes varying from the primary particle size of the insoluble solid to about 20 times that particle size. The incorporation of these materials in a photoconductor matrix results in a photoconductor drum with high lubricity, and has the potential of exhibiting improved wear properties.

The aggregates may be composed of either pure silicone microspheres, fluoropolymers, inorganic particles or mixtures thereof. Although the invention pertains to the use and demonstration of the aggregation/encapsulation technique in a solvent system, it is possible to assume a similar behavior in a non-solvent system (such as molding, extrusion, etc).

In accordance with this invention a charge generation region of a photoconductor has an outer, charge transport region having a charge transport material in a resin binder, as is common. The charge transport region receives charge from the charge generation region during imaging. The lubricity and wear characteristics of the charge transport region are improved by the inclusion in the blend between 0.2 percent and about 1 percent by weight or less silicone oil of viscosity of about 10,000 cs or greater and about 2 percent by weight of inert particles of primary particle size of about 6 micron (μm) or less (the weight percent being to the weight of the charge transport region).

DESCRIPTION OF THE PREFERRED EMBODIMENTS

Test Method: Initial photoinduced decay (PID) was measured by charging the drum using a charge roll, and measuring the discharge voltage as a function of laser energy, using a 780 nm laser. The PID was obtained as a plot of negative photoconductor voltage (−V) against laser energy in micro joules per centimeter ($\mu J/cm^2$). In some cases, the drums were electrically cycled by repeated charge/discharge, for 1000 cycles, and the PID measured, followed by the measurement of the dark decay. Dark decay corresponds to the charge lost as a function of time, and is represented as V/sec. charge/discharge voltages, and the difference corresponds to the fatigue induced in the photoconductor drum due to electrical cycling. Positive fatigue corresponds to photoconductor drums that discharge at lower voltages on cycling (repeated charge/discharge cycles), i.e. if a drum discharges to −200V, and discharges to −150V on cycling, the drum is exhibiting positive fatigue of +50V. In this case, if the drum were to be used in printing a page, the prints corresponding to the lower discharging system would be darker than the initial prints. Similarly, negative fatigue corresponds to a drum exhibiting a discharge voltage that is higher than the initial. For example, if a drum on electrical cycling discharges at −200V instead of its −150V initial discharge, the drum exhibits −50V (or a negative fatigue of 50V). Positive and negative fatigue terminology is also applicable to the change in dark decay for the drum on electrical cycling.

Polysiloxanes:

Polysiloxanes considered with respect to this invention have viscosities ranging from 100-50,000 cs, and were polydimethylsiloxane (PDMS), poly(methylphenyl-co-diphenyl)siloxane (PDMDPS), polymethylphenylsiloxane (PMPS), poly(methyl-2,2,2-trifluoropropyl)siloxane (fluorosilicone). In some cases, the polysiloxanes had hydroxyl end groups.

Inert Materials:

Silicone microspheres ranged in particle size from 0.5 micron (μm) to about 4.5 μm in diameter. These were obtained from GE Silicones. The silicone microspheres were used as-is, without any modifications. The silicone microspheres are sold under the trade name TOSPEARL. This class of inorganic/organic material is insoluble in all known solvents. Silicon microspheres such a TOSPEARL are a complex silicone structure formed of organic silicone compounds which provide a network structure with siloxane bonds extending in three dimensions. TOSPEARL has a spherical appearance and has a mean particle diameter ranging from about 0.1 to about 12.0 microns. Its moisture content at 105° C. is less than 5 percent by weight. It has a true specific gravity of 25° C. of about 1.32 and a bulk specific gravity ranging from about 0.1 to about 0.5. Its specific surface area ranges from about 15 to about 90 $m^2$/gram and has a pH of about 7.5.

Examples and Tests: Polydimethylsiloxane: Polydimethylsiloxane with different viscosities (500 cs and 50000 cs) were formulated in a benzidine based transport solution. Formulations of these transport solutions are presented below:

In the following tables:

TPD is the well known charge transfer material N,N'-bis-(3-methylphenyl)-N,N'-bis-phenyl benzidine;

THF is tetrahydrofuran; and

SM represents TOSPEARL silicone microspheres and SM with a number represents the microspheres of that number.

TABLE 1

Formulations corresponding to various polysiloxanes

| | Material Name | Viscosity |
|---|---|---|
| PDMS-DC200 | Polydimethylsiloxane | 500 cs |
| PMPS | Poly(methyl-phenyl)siloxane | 700 cs |
| Fluorosilicone | Poly(methyl-2,2,2-trifluoropropyl)siloxane | 10000 cs |
| PDMDPS | Poly(dimethyl-diphenyl)siloxane | 30000 cs |
| PDMS-OH | Polydimethylsiloxane-hydroxy terminated | 50000 cs |

TABLE 2

Formulations corresponding to various polysiloxanes in TPD/Polycarbonate A

| Materials | Transport 1 | Transport 2 | Transport 3 | Transport 4 | Transport 5 |
|---|---|---|---|---|---|
| Makrolon-5208 Polycarbonate A | 45.5 g | 45.5 g | 45.5 g | 45.5 g | 45.5 g |
| TPD | 24.5 g | 24.5 g | 24.5 g | 24.5 g | 24.5 g |
| Surfactant (DC-200) | 0.25 g | 0.10 g | 0.10 g | 0.10 g | 0.10 g |
| THF | 210 g | 210 g | 210 g | 210 g | 210 g |
| 1,4-Dioxane | 70 g | 70 g | 70 g | 70 g | 70 g |
| TOSPEARL-120 | 0.70 g | 0.70 g | 0.70 g | 0.70 g | 0.70 g |
| PMPS | 0 g | 0.17 g | 0 g | 0 g | 0 g |
| Fluorosilicone | 0 g | 0 g | 0.17 g | 0 g | 0 g |
| PDMDPS | 0 g | 0 g | 0 g | 0.17 g | 0 g |
| PDMS-OH | 0 g | 0 g | 0 g | 0 g | 0.17 g |

As seen in Table 2, addition of the polysiloxane did not affect the initial electrostatics or the cycling fatigue of the photoconductor. In some cases, the addition of the siloxane resulted in improved sensitivity at the lower laser energy.

In the absence of TOSPEARL silicone microspheres, PDMDPS drum did not exhibit any aggregation of the silicone oil droplet. Coating quality for all drums was similar, and so also the electrostatic fatigue. Hence, it was apparent that the silicone microspheres had a tendency to accumulate on the silicone oil droplet. It may also be noted that the aggregation was dependent on the viscosity of the polysiloxane. No aggregation was observed in the lower viscosity materials (PDMS-DC-200, PMPS or fluorosilicone). However, the higher viscosity materials exhibited a tendency to form aggregates (PDMS-OH and PDMDPS). Both of these materials had viscosities greater than 20 Kcs. Possibly the higher viscosity results in a droplet size that is greater than the silicone microsphere size (2 μm), which in turn promotes aggregation.

TABLE 3

Coating quality and electrostatics

| Additive (1.5%) | ct. wt. (mg/in$^2$) | $V_{0.0\ \mu J/cm^2}$ (0k/1k) | $V_{0.22\ \mu J/cm^2}$ (0k/1k) | $V_{0.33\ \mu J/cm^2}$ (0k/1k) | $V_{1\ \mu J/cm2}$ (0k/1k) | Dark decay (0k/1k) | Coating Quality |
|---|---|---|---|---|---|---|---|
| Control (Transport 1) | 17.2 | −745/−735 | −305/−282 | −179/−151 | −52/−58 | 24/74 | Good |
| PMPS (Transport 2) | 16.6 | −744/−744 | −259/−259 | −133/−143 | −45/−49 | 23/61 | Good |
| Fluorosilicone (Transport 3) | 16.9 | −744/−737 | −277/−238 | −156/−123 | −43/−48 | 33/75 | Good |
| PDMDPS (Transport 4) | 16.9 | −743/−738 | −251/−266 | −127/−142 | −42/−47 | 32/64 | Good |
| PDMS-OH (Transport 5) | 16.3 | −744/−740 | −317/−288 | −186/−153 | −40/−43 | 27/73 | Orange Peel |

As seen in Table 3, the coating quality of drums containing PMPS, fluorosilicone, PDMDPS were similar to the control drum. The drum containing PDMS-OH exhibited a non-uniform (orange peel) coating. Although, the PDMDPS drum coating quality appeared uniform (no bumps on coating surface), closer inspection revealed possible aggregation in the transport layer. This was also observed in the PDMS-OH drum. Drums when viewed under an optical microscope revealed aggregation of the TOSPEARL silicone microspheres, possibly around the siloxane oil droplet. These aggregates of the siloxane oil and silicone microspheres varied in size from about 2 μm (non-aggregated) to about 30 μm. Drums containing PMPS or Fluorosilicone did not exhibit this aggregation behavior. Optical microscopy revealed well dispersed silicone microspheres in the transport layer.

In order to further probe the cause for the aggregation, transports were formulated with siloxane (PMPS or PDMDPS) and compared to a control drum. Tables 4 and 5 correspond to the formulation and their corresponding electrostatics.

TABLE 4

CTL compositions of various polysiloxanes in TPD/Polycarbonate A

| Materials | Transport 6 | Transport 7 | Transport 8 |
|---|---|---|---|
| MAKROLON-5208 Polycarbonate | 45.5 g | 45.5 g | 45.5 g |
| TPD | 24.5 g | 24.5 g | 24.5 g |
| Surfactant (DC-200) | 0.25 g | 0.10 g | 0.10 |
| THF | 210 g | 210 g | 210 g |
| 1,4-Dioxane | 70 g | 70 g | 70 g |
| TOSPEARL-120 | 0.70 g | 0 g | 0 g |
| PMPS | 0 g | 0.70 g | 0 g |
| PDMDPS | 0 g | 0 g | 0.70 g |

TABLE 5

Coating quality and electrostatics

| Additive (1.5%) | ct. wt. (mg/in$^2$) | $V_{0.0\ \mu J/cm^2}$ (0k/1k) | $V_{0.22\ \mu J/cm^2}$ (0k/1k) | $V_{0.33\ \mu J/cm^2}$ (0k/1k) | $V_{1\ \mu J/cm^2}$ (0k/1k) | Dark decay (0k/1k) | Coating Quality |
|---|---|---|---|---|---|---|---|
| Control Transport 6 | 16.1 | −742/−748 | −260/−217 | −134/−100 | −33/−39 | 20/19 | Good |
| PMPS (Transport 7) | 18.7 | −743/−737 | −248/−210 | −105/−93 | −34/−44 | 17/20 | Good |
| PDMDPS (Transport 8) | 17.4 | −747/−742 | −233/−199 | −124/−94 | −36/−42 | 20/18 | Good |

Having determined the cause for aggregate formation, the relationship between the polysiloxane oil and the silicone microsphere blend ratio on the aggregate size and the effect of aggregate size on the electrostatics (fatigue) was explored. The silicone microsphere/silicone oil (PDMDPS) blend ratio was varied as 1/0, 4/1, 4/3, and 1/1 (Table 6), and the resulting drums evaluated for aggregation and electrostatics (Table 7).

TABLE 6

CTL of various polysiloxanes in TPD/Polycarbonate A

| Materials | Transport 9 | Transport 10 | Transport 11 | Transport 12 |
|---|---|---|---|---|
| Makrolon-5208 Polycarbonate | 48.8 g | 48.8 g | 48.8 g | 48.8 g |
| TPD | 26.2 g | 26.2 g | 26.2 g | 26.2 g |
| Surfactant (DC-200) | 0.10 g | 0.10 g | 0.10 g | 0.10 g |
| THF | 225 g | 225 g | 225 g | 225 g |
| 1,4-Dioxane | 75 g | 75 g | 75 g | 75 g |
| TOSPEARL-120 | 0.75 g | 0.75 g | 0.75 g | 0.75 g |
| PDMDPS | 0 g | 0.18 g | 0.54 g | 0.70 g |

TABLE 7

Coating quality and electrostatics

| Additive (1.5%) | ct. wt. (mg/in$^2$) | $V_{0.0\ \mu J/cm^2}$ (0k/1k) | $V_{0.22\ \mu J/cm^2}$ (0k/1k) | $V_{0.33\ \mu J/cm^2}$ (0k/1k) | $V_{1.0\ \mu J/cm^2}$ (0k/1k) | Dark decay (0k/1k) | Coating Quality |
|---|---|---|---|---|---|---|---|
| Control Transport 9 (SM/PDMDPS: 1/0) | 19.8 | −746/−741 | −208/−178 | −97/−92 | −42/−52 | 12/24 | Good |
| Transport 10 (SM/PDMDPS: 4/1) | 19.2 | −736/−735 | −201/−185 | −102/−100 | −44/−57 | 12/17 | Good |
| Transport 11 (SM/PDMDPS: 4/3) | 18.6 | −738/−738 | −199/−190 | −91/−105 | −41/−56 | 12/17 | Good |
| Transport 12 (SM/PDMDPS: 1/1) | 19.9 | −742/−739 | −204/−202 | −92/−116 | −47/−69 | 12/20 | Matte |

| Additive | ct. wt. (mg/in$^2$) | $V_{0.22\ \mu J/cm^2}$ (Fatigue) | $V_{0.33\ \mu J/cm^2}$ (Fatigue) | $V_{1.0\ \mu J/cm2}$ (Fatigue) | Dark decay (Fatigue) | Max. Aggregate Size (μm) |
|---|---|---|---|---|---|---|
| Control Transport 9 (SM/PDMDPS: 1/0) | 19.8 | 30 | 5 | −10 | −12 | 2 |
| Transport 10 (SM/PDMDPS: 4/1) | 19.2 | 16 | 2 | −13 | −5 | 8 |
| Transport 11 (SM/PDMDPS: 4/3) | 18.6 | 9 | −14 | −15 | −5 | 20 |
| Transport 12 (SM/PDMDPS: 1/1) | 19.9 | 2 | −24 | −22 | −8 | 53 |

As can be seen in Table 7, the addition of PDMDPS to the transport matrix does not affect the initial electrostatics of the photoconductor. However, the electrostatics are affected as the photoconductor is electrically cycled. The photoconductor drum tends to exhibit more negative fatigue as the polysiloxane oil concentration is increased. As the silicone oil concentration reaches the silicone microsphere concentration, the aggregate size increases accordingly. For example, the 4/1 blend of silicone microsphere/silicone oil exhibited a maximum aggregate size of about 8 μm (control drum had a 2 μm silicone microsphere), where as the 1/1 blend exhibited a maximum aggregate size of about 53 μm. Although, the number of microspheres are the same in all drums, the aggregate exhibits a different electrostatic behavior as the drum is cycled. Hence it is apparent that by suitably adjusting the silicone microsphere/silicone oil ratio, the aggregate size can be varied accordingly.

Photoconductor drums from Table 6, were evaluated for print quality in a Lexmark OPTRA S2450 printer. The print quality was assessed in an all-white page, all-black page, and a 2×2 isopel (isolated pel) page. No defects relating to the silicone microsphere—silicone oil aggregates were observed.

Stability of Aggregates: The stability of the silicone microspheres/high viscosity silicone oil aggregates was evaluated by preparing the solutions containing these, and evaluating the stability of aggregates using the initial electrostatics of photoconductor drums coated 24 hours apart. Optical micrographs were used to assess the distribution of the aggregates, and determine any settling when the solution/dispersion was not agitated. Initial electrostatics obtained for these drums that were coated 24 hours apart are shown in the following table (Table 8).

TABLE 8

Electrostatics as a function of dispersion stability

| Additive | ct. wt. (mg/in$^2$) | $V_{0.0\ \mu J/cm^2}$ (day 1/day 2) | $V_{1.0\ \mu J/cm^2}$ (day 1/day 2) | Dark decay (day 1/day 2) |
|---|---|---|---|---|
| Control (SM/PDMDPS: 1/0) | 17.9/18.3 | −740/−741 | −40/−48 | 13/14 |
| Transport 10 (SM/PDMDPS: 4/1) | 19.9/20.2 | −745/−735 | −48/−43 | 16/14 |
| Transport 11 (SM/PDMDPS: 4/3) | 18.9/18.3 | −748/−738 | −43/−39 | 16/15 |
| Transport 12 (SM/PDMDPS: 1/1) | 19.6/18.7 | −740/−739 | −44/−43 | 16/14 |

As seen in Table 8, photoconductor drums coated with the same charge transport layer formulations, 24 hours apart, exhibited similar electrostatics. Aggregate size was very similar for drums coated 24 hours apart. Hence it appears that the aggregates are stable and do not exhibit any significant settling, and aggregate size is also unaffected.

Effect of Silicone Microsphere size on Aggregation: In order to further study the aggregation behavior, the effect of the silicone microsphere size on aggregation with a high viscosity poly(dimethyl-diphenyl)siloxane was studied. Silicone microspheres used were TOSPEARL-120 (2 μm), TOSPEARL-130 (3 μm), TOSPEARL-140 (4 μm) and TOSPEARL-240 (4 μm, amorphous). Formulations pertaining to these are similar to Table 8, with the exception of the TOSPEARL grade. The following table (Table 9) summarizes the results from this experiment.

TABLE 9

Silicone microsphere and aggregation

| Additive (1.5%) | ct. wt. (mg/in$^2$) | $V_{0.0\ \mu J/cm^2}$ | $V_{0.22\ \mu J/cm^2}$ | $V_{0.33\ \mu J/cm^2}$ | $V_{1.0\ \mu J/cm^2}$ | Dark decay | Coating Quality |
|---|---|---|---|---|---|---|---|
| Control Transport 13 (SM120/PDMDPS: 1/0) | 19.4 | −736 | −151 | −82 | −42 | 19 | Good |
| Transport 14 (SM120/PDMDPS: 1/1) | 17.8 | −744 | −150 | −72 | −39 | 27 | Matte |
| Transport 15 (SM130/PDMDPS: 1/0) | 21.5 | −733 | −159 | −82 | −46 | 20 | Good |
| Transport 16 (SM130/PDMDPS: 1/1) | 19.9 | −744 | −149 | −72 | −42 | 18 | Matte |
| Control Transport 17 (SM140/PDMDPS: 1/0) | 19.8 | −739 | −186 | −86 | −40 | 15 | Good |
| Transport 18 (SM140/PDMDPS: 1/1) | 19.2 | −746 | −185 | −84 | −39 | 18 | Matte |
| Transport 19 (SM240/PDMDPS: 1/0) | 18.6 | −747 | −163 | −79 | −39 | 21 | Good |
| Transport 20 (SM240/PDMDPS: 1/1) | 19.9 | −747 | −159 | −73 | −40 | 22 | Matte |

In the presence of the polysiloxane, all TOSPEARL microsphere-based systems exhibited aggregation. The presence of the aggregates did not affect the initial electrostatics. The aggregate sizes were not affected by the size of the silicone microspheres.

Effect of Heat on Aggregation: It is possible that the tendency to aggregate and the aggregate size may be increased in the presence of heat. In order to study the effect of heat on the aggregation size, charge transport solutions were stirred at about 50° C. for 0.5 hour, cooled to room temperature and then used for coating. The charge transport solution comprised of 27% TPD in a polycarbonate A matrix and silicone microspheres (TOSPERAL-145, 4.5 μm particle size). Formulations are listed in Table 10, and initial electrostatics for drums coated from these formulations is shown in Table 11.

As seen in Table 11, aggregation and electrostatics of the silicone microspheres/polysiloxane blends were not affected by heat. Based on the optical micrographs, the aggregate sizes were similar for the drums coated with charge transport solutions that were prepared at ambient temperature, or heated at 50° C.

Other Insoluble Additives: Polytetrafluoroethylene: Polytetrafluoroethylene (PTFE) is another insoluble material that was evaluated for aggregation in the presence of high viscosity silicone oils. PTFE was used as a compounded material in Polycarbonate A (LS2030, Mitsubishi Gas Chemicals) or as a blend in Polyethylene (SynFluo-78).

PTFE/PC A blend (LS2030) was formulated to obtain 2% PTFE in the transport matrix. The formulation is shown below:

TABLE 10

Formulations corresponding to Silicone microspheres/polysiloxanes blends

| Materials | Transport 21 | Transport 22 | Transport 23 | Transport 24 | Transport 25 |
|---|---|---|---|---|---|
| Makrolon-5208 Polycarbonate A | 45.5 g | 45.5 g | 45.5 g | 45.5 g | 45.5 g |
| TPD | 19.5 g | 26.2 g | 19.5 g | 19.5 g | 26.2 g |
| Surfactant (DC-200) | 0.10 g | 0.10 g | 0.10 g | 0.10 g | 0.10 g |
| THF | 207 g | 207 g | 207 g | 207 g | 207 g |
| 1,4-Dioxane | 70 g | 70 g | 70 g | 70 g | 70 g |
| TOSPEARL-145 | 0 g | 2.0 g | 2.0 g | 2.0 g | 2.0 g |
| PDMDPS | 0 g | 0 g | 0.97 g | 0 g | 0.97 g |
| Heat | No | No | No | Yes | Yes |

TABLE 11

Effect of heat on electrostatics of silicone microsphere/polysiloxane

| Additive (1.5%) | ct. wt. (mg/in$^2$) | $V_{0.0\ \mu J/cm^2}$ | $V_{0.22\ \mu J/cm^2}$ | $V_{0.33\ \mu J/cm^2}$ | $V_{1.0\ \mu J/cm^2}$ | Dark decay | Aggregation |
|---|---|---|---|---|---|---|---|
| Control Transport 21 | 18.0 | −740 | −157 | −80 | −61 | 24 | No |
| Transport 22 | 17.5 | −748 | −175 | −97 | −76 | 22 | No |
| Transport 23 | 13.8 | −738 | −194 | −96 | −58 | 23 | Yes |
| Transport 24 | 16.6 | −738 | −177 | −111 | −71 | 19 | Yes |
| Transport 25 | 19.8 | −739 | −190 | −95 | −62 | 18 | Yes |

TABLE 12

Formulations corresponding to PTFE/polysiloxane blends

| Materials | Transport 26 | Transport 27 |
|---|---|---|
| Makrolon-5208 Polycarbonate A | 41.0 g | 41.0 g |
| LS2030 PCA | 4.5 | 4.5 |
| TPD | 24.5 g | 24.5 g |
| Surfactant (DC-200) | 0.10 g | 0.10 g |
| THF | 210 g | 210 g |
| 1,4-Dioxane | 70 g | 70 g |
| PDMDPS | 0 g | 0.85 g |

In the absence of the high viscosity PDMDPS silicone oil, amorphous PTFE particles (both primary and aggregated) were less than about 6 μm in size. However, in the presence of the silicone oil, aggregation of the fluoropolymer on the silicone oil was observed, with the particle size of the silicone oil/PTFE aggregate being as large as 50 μm. Although, the aggregates were visible to the naked eye, the drums did not exhibit any significant print defect relating to the aggregates.

Polyethylene (PE)/PTFE Blend: SynFluo-178XF (Polyethylene/PTFE blend) was also formulated without or with Poly(dimethyl-diphenyl)siloxane, in a manner similar to Table 12. Results were similar, in the presence of the silicone oil, aggregates of PE/PTFE in the oil were observed.

Metal Stearates: Metal stearates are used in toner formulations, as an extra particular additive. These stearates have been known to improve transfer-efficiency during the printing process. The zinc stearate evaluated was Nagase MZN-60, with a primary particle size of about 2 μm. Coating on the drum was relatively uniform for both the non-silicone oil drums and silicone oil drums. Surface microscopy of drums revealed aggregates of Zinc Stearate on the silicone oil.

Surface profilometry: Surface profilometry of drums containing TOSPEARL silicone microspheres and its aggregates on a silicone oil were measured. The difference in coating profile was no more than 2 microns for the aggregates in comparison to a control drum. This suggests that the aggregates are flat on the surface and do not actually cause bumps on the drum.

Hence it is apparent from the foregoing that insoluble particles such as silicone microspheres, fluoropolymers, and inorganic solids such as stearates can be made to aggregate on droplets of silicone oil that has a viscosity of at least 10000 centistokes. These aggregates do not cause any print defects. They may be used where stability of the additive is required, and also in areas that may require a slow release of silicone oil over time.

What is claimed is:

1. A photoconductor for use in electrophotographic imaging comprising a charge generation region and an outer, charge transport region responsive to charge from said charge generation region during imaging, said charge transport region comprising a blend of a resin binder, a charge transport material, an amount in the range of about 0.2 percent and about 1 percent by weight of the weight of said charge transport region of a silicone oil of viscosity of about 10,000 cs or greater, and about two percent by weight of the weight of said charge transport region of inert particles of primary particle size of about 6 μm or less.

2. The photoconductor member of claim 1 in which said silicone oil is in amount of about 1 percent by weight of the weight of said charge transport region.

3. The photoconductor member of claim 1 in which said silicone oils is in amount of about 0.2 percent by weight of the weight of said charge transport region.

4. The photoconductor member of claim 1 in which said inert particles are silicone microspheres.

5. The photoconductor member of claim 2 in which said inert particles are silicone microspheres.

6. The photoconductor member of claim 3 in which said inert particles are silicone microspheres.

7. The photoconductor member of claim 4 in which said silicone microspheres have a primary particle size of about 2 microns.

8. The photoconductor of claim 5 in which said silicone microspheres have a primary particle size of about 2 microns.

9. The photoconductor of claim 6 in which said silicone microspheres have a primary particle size of about 2 microns.

10. The photoconductor member as in claim 1 in which said inert particles are polytetrafluoroethylene.

11. The photoconductor member as in claim 1 in which said inert particles are metal stearates.

12. The photoconductor member as in claim 11 in which said metal stearate is zinc stearate.

13. The photoconductor member as in claim 1 in which said silicone oil is poly(dimethyl-diphenyl)siloxane.

14. The photoconductor member as in claim 2 in which said silicone oil is poly(dimethyl-diphenyl)siloxane.

15. The photoconductor member as in claim 3 in which said silicone oil is poly(dimethyl-diphenyl)siloxane.

16. The photoconductor member as in claim 4 in which said silicone oil is poly(dimethyl-diphenyl)siloxane.

17. The photoconductor member as in claim 5 in which said silicone oil is poly(dimethyl-diphenyl)siloxane.

18. The photoconductor member as in claim 6 in which said silicone oil is poly(dimethyl-diphenyl)siloxane.

19. The photoconductor member as in claim 7 in which said silicone oil is poly(dimethyl-diphenyl)siloxane.

20. The photoconductor member as in claim 8 in which said silicone oil is poly(dimethyl-diphenyl) siloxane.

21. The photoconductor member as in claim 9 in which said silicone oil is poly(dimethyl-diphenyl) siloxane.

22. The photoconductor member as in claim 1 in which said silicone oil is polydimethylsiloxane-hydroxy terminated.

23. The photoconductor member as in claim 2 in which said silicone oil is polydimethylsiloxane-hydroxy terminated.

24. The photoconductor member as in claim 3 in which said silicone oil is polydimethylsiloxane-hydroxy terminated.

25. The photoconductor member as in claim 4 in which said silicone oil is polydimethylsiloxane-hydroxy terminated.

26. The photoconductor member as in claim 5 in which said silicone oil is polydimethylsiloxane-hydroxy terminated.

27. The photoconductor member as in claim 6 in which said silicone oil is polydimethylsiloxane-hydroxy terminated.

28. The photoconductor member as in claim 7 in which said silicone oil is polydimethylsiloxane-hydroxy terminated.

29. The photoconductor member as in claim 8 in which said silicone oil is polydimethylsiloxane-hydroxy terminated.

30. The photoconductor member as in claim 9 in which said silicone oil is polydimethylsiloxane-hydroxy terminated.

* * * * *